US005542723A

United States Patent [19]

Scharf

[11] Patent Number: 5,542,723

[45] Date of Patent: Aug. 6, 1996

[54] PORTABLE PRIVACY LOCK

[76] Inventor: Kenneth R. Scharf, 414 S. Craig St., Suite 207, Pittsburgh, Pa. 15213

[21] Appl. No.: 533,655

[22] Filed: Sep. 25, 1995

[51] Int. Cl.[6] ..... E05C 19/18

[52] U.S. Cl. ..... 292/289; 292/288; 292/258

[58] Field of Search ..... 292/288, 289, 292/290, 297, 296, 258, DIG. 16; 70/14, 19; 2/311, 338, 336, 341, 339

[56] References Cited

U.S. PATENT DOCUMENTS

| | | | |
|---|---|---|---|
| 1,607,789 | 11/1926 | Baker | 292/290 |
| 3,183,319 | 5/1965 | Hudon | 292/289 |
| 3,596,961 | 8/1971 | Lippman | 292/292 |
| 4,326,394 | 4/1982 | Stein | 70/14 |
| 4,330,146 | 5/1982 | Sessions, Jr. | 292/258 |
| 4,589,692 | 5/1986 | Boyd | 292/297 |
| 5,280,977 | 1/1994 | Piva | 292/296 |
| 5,291,760 | 3/1994 | Schrader | 70/14 |
| 5,415,444 | 5/1995 | Hull et al. | 292/288 |

*Primary Examiner*—Steven N. Meyers
*Assistant Examiner*—Donald J. Lecher
*Attorney, Agent, or Firm*—David J. Hill

[57] ABSTRACT

A portable privacy lock is disclosed for use in securing a door that swings on hinges from an open position to a closed position in which the edge of the door opposite its hinged side is adjacent to a closure surface with a clearance gap therebetween. The lock includes a flexible webbing which has a first end and a second end, and which is provided with a plurality of holes between said first and second ends. The lock also includes a first securing plate that is attached to the first end of the webbing and a second securing plate that is attached to the webbing at an intermediate position between the first and second ends thereof. The second plate is also provided with a hole that is aligned with one of the holes in the webbing. The lock also includes a latch that is adapted to receive a drawstring and to releasably engage it from motion with respect thereto, and a drawstring, one end of which is attached to the first plate or to the first end of the webbing. The drawstring is threaded through the holes in the webbing and the second plate to engagement with the latch. The lock is utilized by inserting the first plate through the clearance gap between the door and its adjacent closure surface. The latch is disengaged from the drawstring so that the drawstring may be pulled to fold the webbing to move the second plate into position across the clearance gap and on the opposite side thereof from the first plate, so as to secure the door from motion with respect to the adjacent closure surface. The latch may then be engaged to hold the drawstring so as to maintain the plates in position with respect to each other.

20 Claims, 4 Drawing Sheets

PORTABLE PRIVACY LOCK

FIELD OF THE INVENTION

This invention is a portable device for use in securing a hinged door in its closed position. It is particularly useful in securing the doors of toilet stalls to provide added privacy and peace of mind for the user.

BACKGROUND AND DESCRIPTION OF THE PRIOR ART

A number of supplemental or auxiliary door locks have been devised for attachment to a hinged door to secure it in a closed position against unauthorized opening. Many of these door locks are not truly portable, because they require that modifications be made to the door jamb or frame. However, several require no such modifications, and may be carried from place to place by the user. Among these are the adjustable brace-type locks that are designed to be placed with one end against the floor and the other against the door, frequently at the doorknob. These braces are generally too large to be carried in a pocket, briefcase or purse, and consequently, smaller and more easily-transported door-locking devices have also been developed. Most of these small, portable door-locking devices are adapted to operate in connection with the type of door having a jamb against which the door abuts when it is in its closed position. Furthermore, many of these locks are useful only with doors having locking bolts that are received in a bolt keeper recess or hole in the door jamb. Thus, for example, U.S. Pat. No. 3,596,961 of Lippman describes a portable door lock having a toothed latch bar with a hook for engaging the side of the keeper hole in a striker plate on the door frame. A resilient U-shaped band is provided that is slidable on the latch bar, and which has overlying cross tabs extending across the ends of the "U" to engage the teeth and thereby to block the door from opening.

U.S. Pat. No. 4,589,692 of Boyd describes a portable door lock that includes a thin sheet metal strap that fits between the door and the door jamb. This strap has a fixed bolt on one end that is received in the keeper hole of the striker on the jamb when the door is open. The strap is placed with the bolt in the keeper hole, and the door is closed. A locking dog or brace that is pivotally mounted on the other end of the strap is then pivoted so as to overlap the strap and engage against the inner side of the door.

U.S. Pat. No. 5,280,977 of Piva describes a portable door lock that includes a generally flat base having a tooth thereon that is adapted to be received in the keeper hole of the striker on the jamb when the base is positioned next to the jamb and extending into the room to be locked. A locking arm connected to the base is movable against a bias inherent in the arm to a position that blocks the door from being opened. A peg may be inserted between the locking arm and the base to hold the arm in the blocking position against the bias.

U.S. Pat. No. 5,415,444 of Hull et al. describes a portable door lock that does not require cooperation with a keeper hole in a door jamb. However, this door lock does require cooperation with a door knob. This lock includes a metal or plastic flexible strap that is attached at one end to a pair of interlocked tubular bars. The tubular bars are positioned outside the door at the base thereof with the strap passing underneath the bottom of the door. The other end of the strap has a bolt through it which is encircled by a loop of one end of a rope or cable. The other end of the rope is formed into a second loop that encircles the doorknob. In use the tubular bars are positioned so that one of the tubular bars abuts the outside of the door and the other abuts the outside of the adjacent door frame. The rope is then tightened to pull the strap taut so that the door cannot be opened from the outside.

U.S. Pat. No. 1,607,789 of Baker describes a portable door lock that is not designed for operation on doors that cooperate in closing with a door jamb. This lock comprises a U-shaped frame having a plurality of leaves therein. The leaves are pivotally connected to each other and to the frame by a pivot pin. The pivot pin extends through slots in the side walls of the frame thereby permitting the frame to be adjusted relative to the leaves. The forward ends of the outside leaves on each side are provided with right-angularly bent, laterally-directed biting teeth for engaging a door and a cooperating door frame when the leaves are positioned in the space or gap therebetween. In addition, each leaf is provided with a plurality of equidistantly spaced teeth that are aligned with each other. The frame also includes a bifurcated foot that is adapted to engage between the teeth on the leaves and to abut with the door and frame when the lock is in place on the door. By providing a plurality of leaves in the frame, the lock of Baker can accommodate a variety of gap sizes between the door and its cooperating frame. However, the lock of Baker is somewhat complicated in that it includes many cooperating parts.

Another portable door lock which does not require that a door abut against a door jamb in its closed position is that of U.S. Pat. No. 4,326,394 of Stein. However, this door lock, unlike the others described herein, is designed for locking a door from the outside only. It includes a metal Z-shaped bar which is adapted for insertion between a door and a door frame. Both parallel sides of the Z-shaped bar are provided with a series of holes, and the lock assembly also includes a front and a rear sliding bar, each having a slot that is adapted for receiving the front or the rear portion of the Z-shaped bar. The Z-bar is fitted into the slot of the rear sliding bar, and a bolt is placed through a hole in the Z-bar to hold the rear bar in place so that the transverse arm of the Z-bar engages the front of the door when the door is closed with the Z-bar in the gap between the door and the frame and the rear sliding bar engaging both the frame and the door on the inside of the room to be locked. The slot of the front sliding bar is then placed over the end of the Z-bar outside the room and slid to engage the front of the door and frame. A padlock is then placed through a hole in the end of the Z-bar outside the room to hold the front sliding bar in place.

It can be appreciated therefore that most of the various portable door locks that are known for use in securing hinged doors are designed for use with the standard door and frame arrangement, whereby a hinged door cooperates with a door frame or jamb against which the door abuts when it is in its closed position. Many of the known portable door locks also require that the door have a locking bolt that is received in a bolt keeper recess or hole in a cooperating door jamb. Several of the known portable door locks are somewhat complicated, in that they involve a large number of cooperating components, or they require that the door, frame or jamb be modified to accommodate their use. Consequently, as can be seen from the foregoing discussion, although a number of portable devices have been developed for use in securing hinged doors in the closed position, all are subject to various limitations and disadvantages.

OBJECTS AND ADVANTAGES OF THE INVENTION

Accordingly, it is an object of the invention claimed herein to provide a portable privacy lock that is simple to manufacture and use, and which may be carried in a pocket or purse. It is another object of this invention to provide such a lock that can be utilized to secure a hinged door whether or not it cooperates with a door frame or jamb against which the door abuts when it is in its closed position. It is still another object of the invention to provide a portable privacy lock that can be utilized to secure a hinged door that does not have a locking bolt that is received in a bolt keeper recess or hole in a cooperating door jamb. It is yet another object of the invention to provide a portable privacy lock that can be used to secure a door that swings on hinges from an open position to a closed position in which the edge of the door opposite its hinged side is adjacent to a closure surface with a clearance gap therebetween. It is still another object of the invention to provide such a lock that can be used in connection with doors that are arranged in various configurations with adjacent closure surfaces.

Additional objects and advantages of this invention will become apparent from an examination of the drawings and the ensuing description.

SUMMARY OF THE INVENTION

A portable privacy lock is disclosed for use in securing a door that swings on hinges from an open position to a closed position in which the edge of the door opposite its hinged side is adjacent to a closure surface with a clearance gap therebetween. The lock includes a flexible webbing having a first end and a second end, said webbing being provided with a plurality of holes between its first and second ends. The lock also includes a first securing plate and a second securing plate. The first securing plate is attached to the first end of the webbing, and the second securing plate is attached to the webbing at an intermediate position between the first and second ends thereof. The second plate is also provided with a hole that is aligned with one of the holes in the webbing. The lock also includes a latch that is adapted to receive a drawstring and to releasably engage it from motion with respect thereto, and a drawstring, one end of which is attached to the first plate or to the first end of the webbing. The drawstring is threaded through the holes in the webbing and the second plate to engagement with the latch. The lock is utilized by inserting the first plate through the clearance gap between the door and its adjacent closure surface. The latch is disengaged from the drawstring so that the drawstring may be pulled to fold the webbing so that the second plate may be moved into position across the clearance gap and on the opposite side thereof from the first plate. The door is thereby secured from motion with respect to the adjacent closure surface, whereupon the latch may be engaged to hold the drawstring so as to maintain the plates in position with respect to each other.

In order to facilitate an understanding of the invention, the preferred embodiments of the invention are illustrated in the drawings, and a detailed description thereof follows. It is not intended, however, that the invention be limited to the particular embodiments described or to use in connection with the doors illustrated herein. Various changes are contemplated such as would ordinarily occur to one skilled in the art to which the invention relates.

DESCRIPTION OF THE PREFERRED EMBODIMENTS OF THE INVENTION

Figure 1:
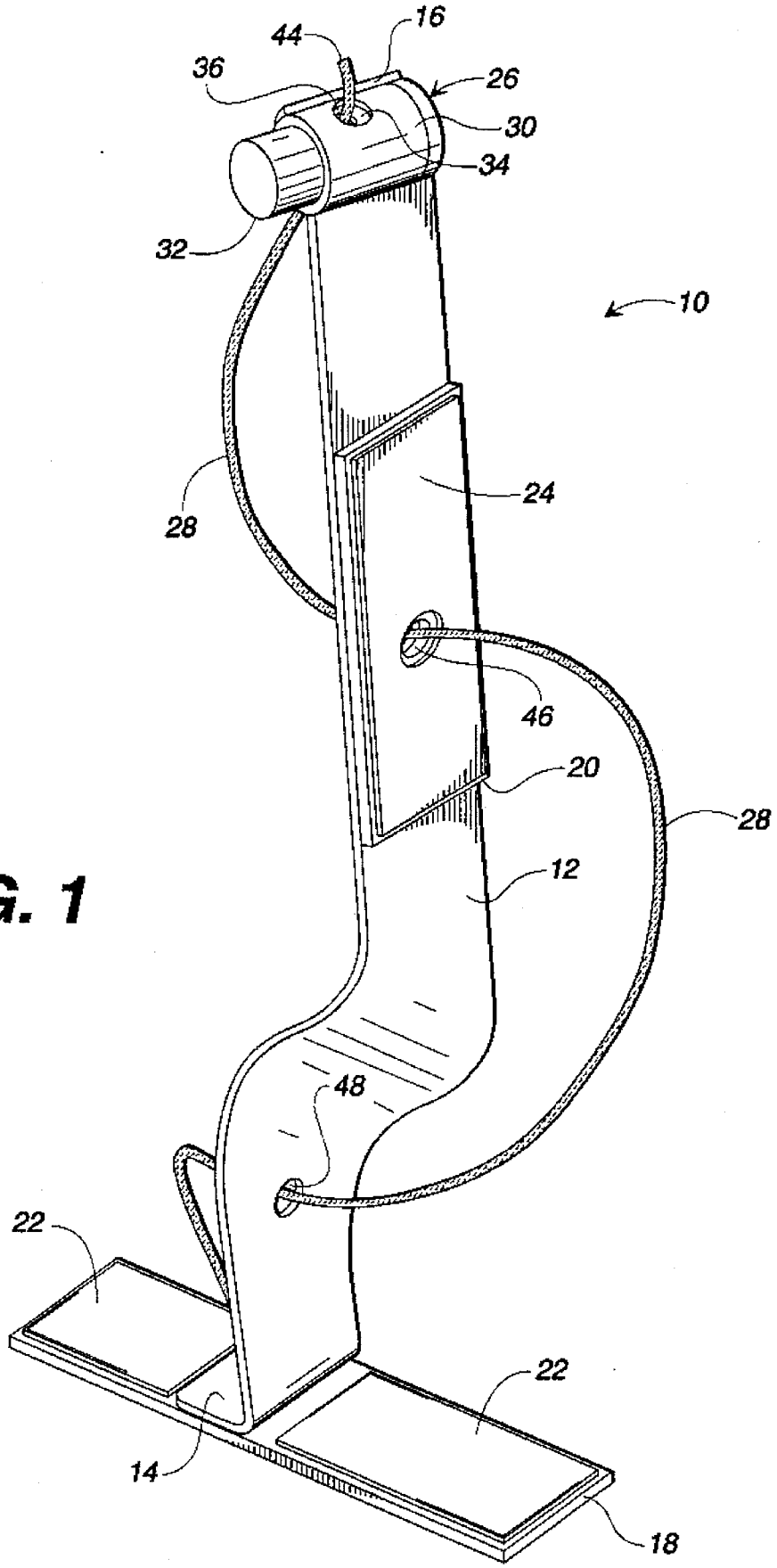
FIG. 1 is a perspective view of a preferred embodiment of the invention.
Figure 2:
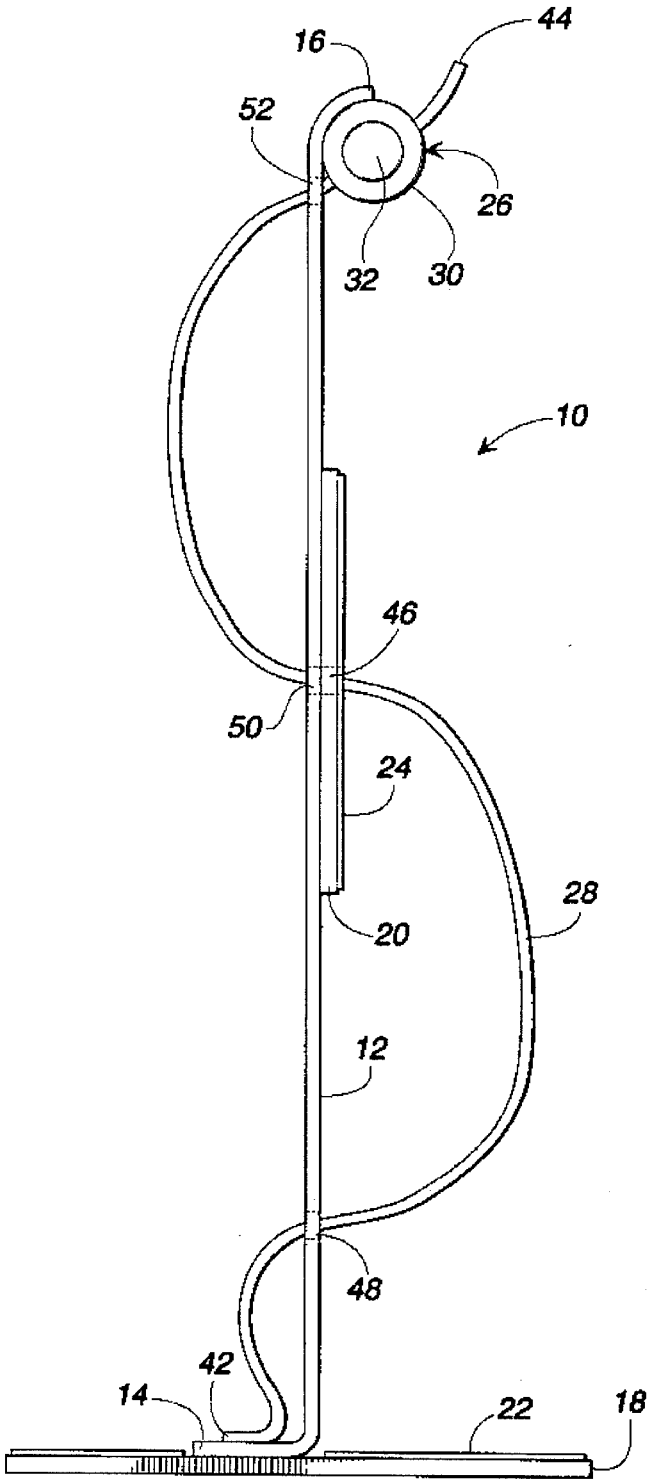
FIG. 2 is a side view of the preferred embodiment of FIG. 1.

Referring now to FIGS. 1 and 2, a preferred embodiment of the invention is shown, which is useful in securing a door that swings on hinges from an open position to a closed position in which the edge of the door opposite its hinged side is adjacent to a closure surface with a clearance gap therebetween. As used herein, a "closure surface" is a surface, structure or arrangement of surfaces or structures against which the invention engages to secure a hinged door in the closed position. As shown in FIGS. 1 and 2, portable privacy lock 10 includes flexible webbing 12 having a first end 14 and a second end 16. The webbing is preferably of a woven nylon construction, although other types of webbing, such as canvas or other fabric, or a metallic or plastic strapping, may be successfully employed. The webbing must be flexible and strong, and it is preferably light in weight. A first securing plate 18 is attached to first end 14 of webbing 12. Preferably the attachment between the first end of the webbing and the first securing plate is located near a central portion of first securing plate 18 and along a portion of its length. A second securing plate 20 is attached to the webbing at an intermediate position between the first and second ends thereof. Preferably, second securing plate 20 is attached to webbing 12 substantially along its entire length. The securing plates may be formed of any convenient rigid or semirigid material, such as metal, plastic, a resin-impregnated glass fiber mat, such as is sold under the trademark Fiberglass, or the like.

Preferably, the securing plates are attached to the webbing by means of an adhesive, such as an epoxy resin, although any other convenient means of attachment can be used.

Preferably the first securing plate has a non-skid surface 22 on the side thereof to which the webbing is attached, and the second securing plate has a non-skid surface 24 on the side opposite that which is attached to the webbing. These non-skid surfaces may be provided by a relatively thin layer of rubber, vinyl or the like that is attached to the securing plates by adhesive or other convenient means. In the alternative, the appropriate surfaces of the securing plates may be roughened by mechanical or chemical means, or a rough texture may be imparted in the manufacturing process.

Figure 3:
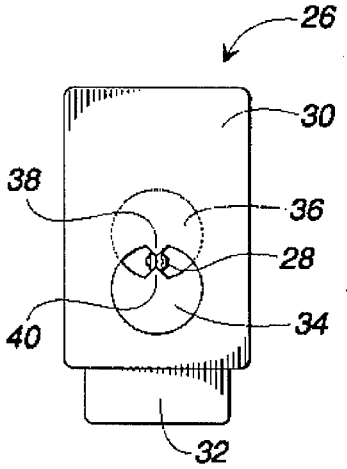
FIG. 3 is a plan view of the latch of the invention that is illustrated in FIGS. 1 and 2, showing it in a position of locking engagement with the drawstring of the invention.

Portable privacy lock 10 also includes a latch 26 that is adapted to receive a drawstring 28 and to releasably engage it from motion with respect thereto. Preferably, the latch is adapted to releasably engage the drawstring from motion with respect thereto by frictional engagement. Furthermore, preferably the latch is attached to the webbing at or near the second end thereof, by use of an adhesive or by other convenient means. Latch 26 is a modified version of the cord clamp that is described and claimed in U.S. Pat. No. 4,328,605, which is assigned to T-Plastech Company of Denver, Colo. Latch 26 includes an outer sleeve 30 and a plunger 32 which are axially movable with respect to each other. Sleeve 30 and plunger 32 are each provided with alignable openings 34 and 36 respectively, and a spring is provided (not shown) to urge separation of the sleeve and plunger so that openings 34 and 36 are biased to be out of radial alignment. Sleeve 30 is provided with tooth 38 which projects into opening 34 and plunger 32 is provided with opposed tooth 40 which projects into opening 36. Teeth 38 and 40 cooperate with the biased non-alignment of openings 34 and 36 to engage drawstring 28, as is shown in FIG. 3, so as to hold it securely unless the plunger and sleeve are axially moved against the bias of the spring with respect to each other. Openings 34 and 36 are otherwise preferably substantially circular.

Drawstring 28 is a flexible cord or string that is preferably formed of nylon, cotton or similar material. Its first end 42 is attached to first securing plate 18 by means of an adhesive such as the epoxy resin that is preferably used to attach the first and second securing plates to the webbing. In the alternative, first end 42 of drawstring 28 may be passed through a hole (not shown) in first plate 18 and knotted so as to be secured thereto. In yet another alternative, which may be the most preferred, first end 42 of drawstring may be attached to first end 14 of webbing 12, preferably by being sewn thereto, or by means of an adhesive. As used herein, "attachment of one end of the drawstring to the first plate" is considered to encompass or include any and all of the aforementioned means of attachment of one end of the drawstring, including attachment of the drawstring to the first end of the webbing. Preferably, first end 42 of the drawstring is attached to the first securing plate adjacent to the point of attachment of the first securing plate to the webbing, or to the webbing adjacent to the point of attachment of the webbing to the first securing plate.

Drawstring 28 is threaded through the holes in the webbing and the second plate (described hereinafter) to engagement with latch 26. Webbing 12 is also provided with a plurality of holes between said first and second ends, and second securing plate 20 is provided with a hole 46 that is aligned with one of the holes in the webbing. The preferred embodiment of the invention includes three holes 48, 50 and 52 through webbing 12 for passage of the drawstring therethrough. First hole 48 is preferably located near the point of attachment of the first securing plate to the webbing, and second hole 50 is preferably aligned with hole 46 in the second securing plate. Third hole 52 is preferably located near the second end 16 of webbing 12, near the point of attachment of latch 26 to the webbing. It should be appreciated that any convenient number of holes may be provided in the webbing for passage of the drawstring therethrough, so long as the drawstring may be pulled as described herein to fold the webbing so as to properly position the first and second securing plates.

The invention may be utilized to secure a door that swings on hinges from an open position to a closed position in which the edge of the door opposite its hinged side is adjacent to a closure surface with a clearance gap therebetween. The invention is suitable for use with a variety of arrangements of doors and adjacent closure surfaces, as shown in FIGS. 4 through 9. In all such uses, the first securing plate is inserted through the clearance gap between the door and its adjacent closure surface. The latch is disengaged from the drawstring so that the drawstring may be pulled to fold the webbing so that the second plate is moved into position across the clearance gap and on the opposite side thereof from the first plate. As used herein, "pulling of the drawstring to fold the webbing" relates to relative motion between the drawstring and the latch, or any other action which acts to shorten the portion of the drawstring between the first securing plate and the latch and to lengthen the portion of the drawstring beyond the latch. It may also be described as "pushing the latch along the drawstring to fold the webbing". By such action, the webbing folds between the first and second securing plates and between the second securing plate and the latch, and the second securing plate is moved into a position across the clearance gap and on the opposite side thereof from the first securing plate so as to secure the door from motion with respect to the adjacent closure surface, whereupon the latch may be engaged to hold the drawstring so as to maintain the plates in position with respect to each other.

Figure 4:
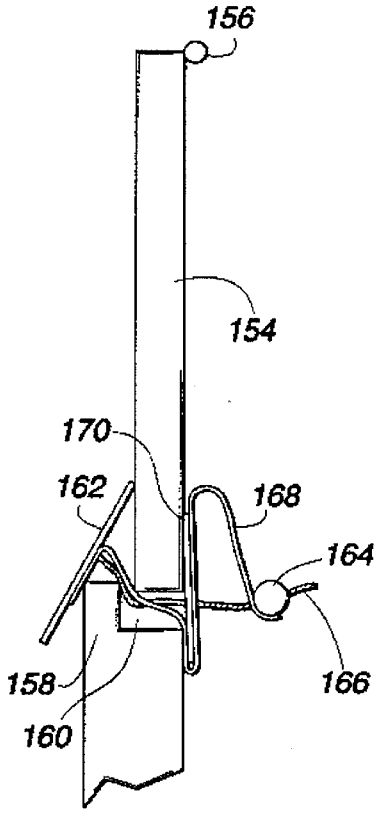
FIG. 4 is a schematic view of a first arrangement of a hinged door and its adjacent closure surface with which the invention may be used.

FIG. 4 shows a schematic arrangement of a hinged door and an adjacent closure surface that is quite common. As shown therein, door 154, hinged at 156, is adapted to cooperate with a door frame or jamb 158 against which the door abuts when it is in its closed position. Clearance gap 160 is created by the cooperation of door 154 and the adjacent closure surface of door jamb 158. First securing plate 162 may be inserted through the clearance gap between the door and its adjacent closure surface and the latch 164 disengaged from the drawstring 166 so that the drawstring may be pulled to fold the webbing 168 so that second plate 170 is moved into position across the clearance gap and on the opposite side thereof from the first plate so as to secure the door 154 from motion with respect to the adjacent closure surface 158, whereupon latch 164 may be engaged to hold the drawstring so as to maintain the plates in position with respect to each other.

Figure 5:
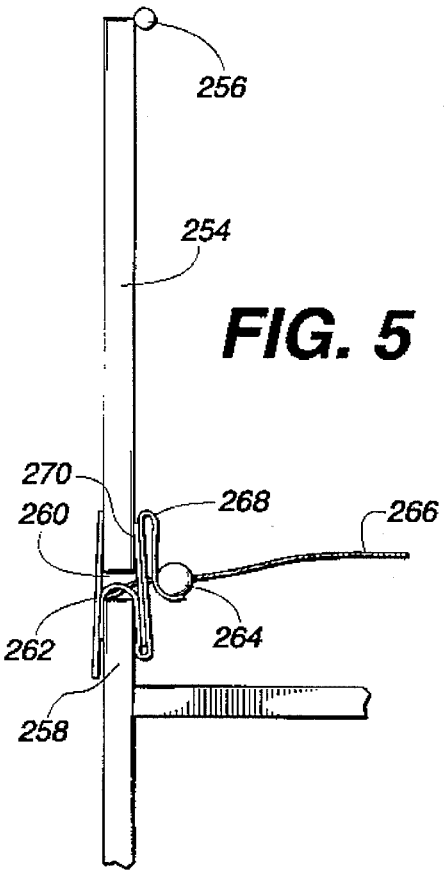
FIG. 5 is a schematic view of a second arrangement of a hinged door and its adjacent closure surface with which the invention may be used.

FIG. 5 shows a schematic arrangement of a hinged door and adjacent closure surface that is commonly found in the toilet stalls of public restrooms, wherein the door and the adjacent closure surface is aligned, with a small clearance gap therebetween. Such stalls are frequently provided with inadequate locking mechanisms. In other situations, the maintenance of the locking means that are provided is frequently neglected. As shown in FIG. 5, door 254, hinged at 256, is adapted to cooperate with adjacent closure surface 258 to close off the restroom stall. Clearance gap 260 is created by the cooperation of door 254 and adjacent closure surface 258. First securing plate 262 may be inserted through the clearance gap between the door and its adjacent closure surface and the latch 264 disengaged from the drawstring 266 so that the drawstring may be pulled to fold the webbing 268 so that second plate 270 is moved into position across the clearance gap and on the opposite side thereof from the first plate so as to secure the door 254 from motion with respect to the adjacent closure surface 258, whereupon latch 264 may be engaged to hold the drawstring so as to maintain the plates in position with respect to each other.

Figure 6:
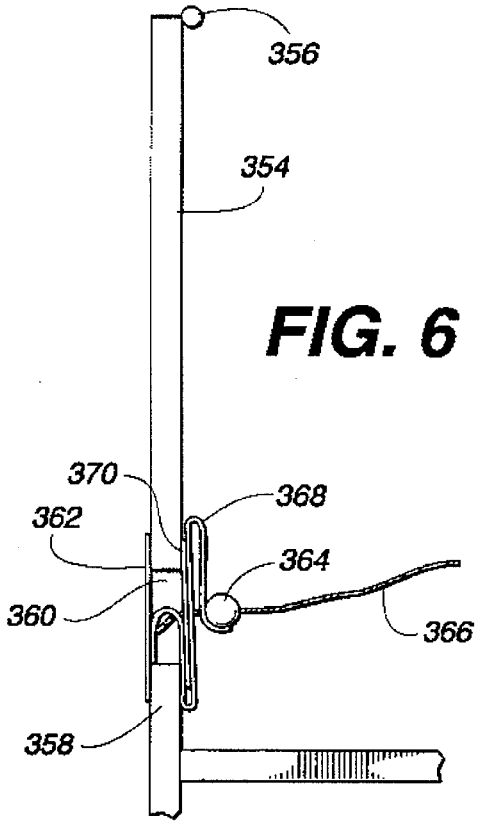
FIG. 6 is a schematic view of a third arrangement of a hinged door and its adjacent closure surface with which the invention may be used.

FIG. 6 shows an alternative schematic arrangement of a hinged door and adjacent closure surface that may be found in the toilet stalls of public restrooms, wherein the door and the adjacent closure surface is aligned, with a large clearance gap therebetween. As shown therein, door 354, hinged at 356, is adapted to cooperate with an adjacent closure surface 358 to close off the restroom stall. Clearance gap 360 is created by the cooperation of door 354 and adjacent closure surface 358. First securing plate 362 may be inserted through the clearance gap between the door and its adjacent closure surface and the latch 364 disengaged from the drawstring 366 so that the drawstring may be pulled to fold the webbing 368 so that second plate 370 is moved into position across the clearance gap and on the opposite side thereof from the first plate so as to secure the door 354 from motion with respect to the adjacent closure surface 358, whereupon latch 364 may be engaged to hold the drawstring so as to maintain the plates in position with respect to each other.

Figure 7:
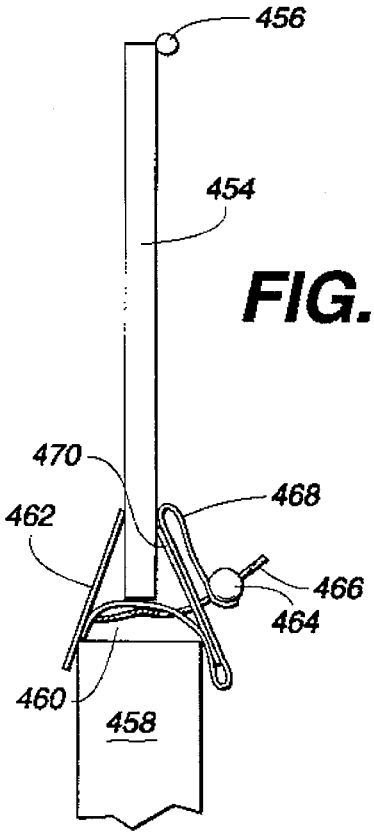
FIG. 7 is a schematic view of a fourth arrangement of a hinged door and its adjacent closure surface with which the invention may be used.

FIG. 7 shows an alternative schematic arrangement of a hinged door and adjacent closure surface that may be found in the toilet stalls of public restrooms, wherein the door and the adjacent closure surface is aligned, but there is a significant difference in the relative thicknesses of the door and adjacent closure surface member. As shown in FIG. 7, door 454, hinged at 456, is adapted to cooperate with an adjacent closure surface 458 to close off the restroom stall. Clearance gap 460 is created by the cooperation of door 454 and adjacent closure surface 458. First securing plate 462 may be inserted through the clearance gap between the door and its adjacent closure surface and the latch 464 disengaged from the drawstring 466 so that the drawstring may be pulled to fold the webbing 468 so that second plate 470 is moved into position across the clearance gap and on the opposite side thereof from the first plate so as to secure the door 454 from motion with respect to the adjacent closure surface 458, whereupon latch 464 may be engaged to hold the drawstring so as to maintain the plates in position with respect to each other.

Figure 8:
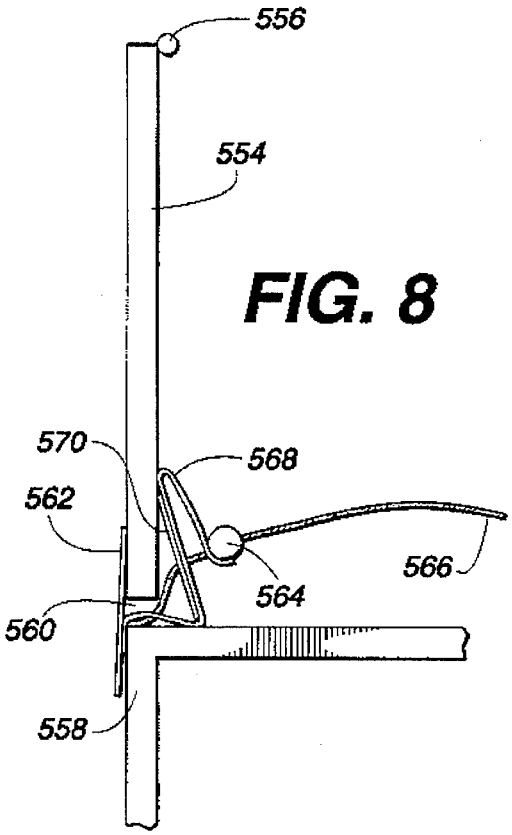
FIG. 8 is a schematic view of a fifth arrangement of a hinged door and its adjacent closure surface with which the invention may be used.

FIG. 8 shows an alternative schematic arrangement of a hinged door and adjacent closure surface that may be found in the toilet stalls of public restrooms, wherein the adjacent closure surface with which the door cooperates comprises a right-angled section. As shown in FIG. 8, door 554, hinged at 556, is adapted to cooperate with the adjacent closure surface 558 to close off the restroom stall. Clearance gap 560 is created by the cooperation of door 554 and adjacent closure surface 558. First securing plate 562 may be inserted through the clearance gap between the door and its adjacent closure surface and the latch 564 disengaged from the drawstring 566 so that the drawstring may be pulled to fold the webbing 568 so that second plate 570 is moved into position across the clearance gap and on the opposite side thereof from the first plate so as to secure the door 554 from motion with respect to the adjacent closure surface 558, whereupon latch 564 may be engaged to hold the drawstring so as to maintain the plates in position with respect to each other.

Figure 9:
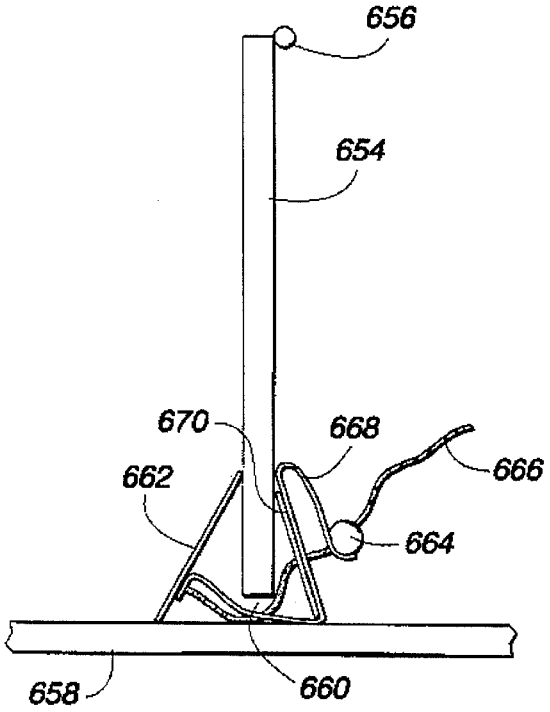
FIG. 9 is a schematic view of a sixth arrangement of a hinged door and its adjacent closure surface with which the invention may be used.

FIG. 9 shows an alternative schematic arrangement of a hinged door and adjacent closure surface that may be found in the toilet stalls of public restrooms, wherein the door abuts an adjacent closure surface arranged at right-angles therewith. As shown in FIG. 9, door 654, hinged at 656, is adapted to cooperate with the adjacent closure surface 658 to close off the restroom stall. Clearance gap 660 is created by the cooperation of door 654 and adjacent closure surface 658. First securing plate 662 may be inserted through the clearance gap between the door and its adjacent closure surface and the latch 664 disengaged from the drawstring 666 so that the drawstring may be pulled to fold the webbing 668 so that second plate 670 is moved into position across the clearance gap and on the opposite side thereof from the first plate so as to secure the door 654 from motion with respect to the adjacent closure surface 658, whereupon latch 664 may be engaged to hold the drawstring so as to maintain the plates in position with respect to each other.

Figure 10:
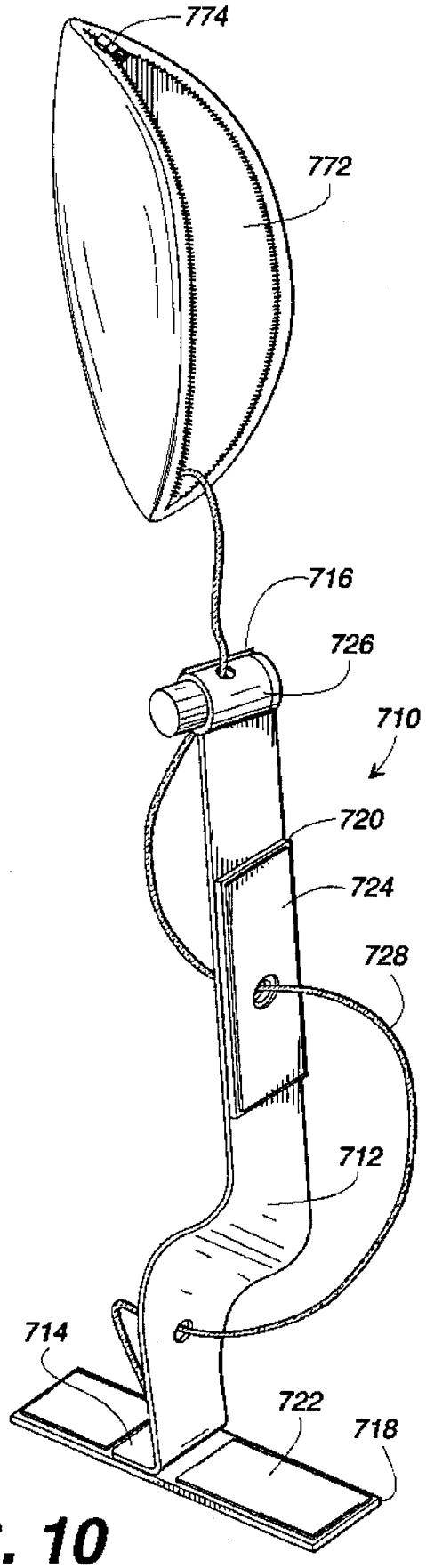
FIG. 10 is a perspective view of an alternative embodiment of the invention.

FIG. 10 illustrates a preferred embodiment of the invention that is similar to the embodiment of FIGS. 1 and 2. As shown therein, portable privacy lock 710 includes flexible webbing 712 having a first end 714 and a second end 716. A first securing plate 718 is attached to first end 714 of webbing 712, and a second securing plate 720 is attached to the webbing at an intermediate position between the first and second ends thereof. Preferably the first securing plate has a non-skid surface 722 on the side thereof to which the webbing is attached, and the second securing plate has a non-skid surface 724 on the side opposite that which is attached to the webbing.

Portable privacy lock 7 10 also includes a latch 726 that is adapted to receive a drawstring 728 and to releasably engage it from motion with respect thereto. Latch 726 is identical to latch 26 of FIGS. 1 through 3, and preferably is attached to the webbing at or near second end 716 thereof, by use of an adhesive or by other convenient means.

Drawstring 728 is a flexible cord or string, a first end of which (not shown) is attached to first securing plate 718. Drawstring 728 is threaded through holes in the webbing and the second plate to engagement with latch 726. A pouch 772, that is adapted to contain the lock, is attached to the second end (not shown) of the drawstring. Pouch 772 is provided with zippered closure 774, which may be utilized to close the pouch with lock 710 inside. In the alternative, the pouch could be closed by means of snaps, buttons, a hook and loop fastener such as is sold under the trademark Velcro, or the like.

This embodiment of the invention may be utilized in the same way as is lock 10 of FIGS. 1 and 2 to secure a door that swings on hinges from an open position to a closed position in which the edge of the door opposite its hinged side is adjacent to a closure surface with a clearance gap therebetween. The first securing plate is inserted through the clearance gap between the door and its adjacent closure surface. The latch is disengaged from the drawstring so that the drawstring may be pulled to fold the webbing so that the second plate is moved into position across the clearance gap and on the opposite side thereof from the first plate, so as to secure the door from motion with respect to the adjacent closure surface. The latch may then be engaged to hold the drawstring so as to maintain the plates in position with respect to each other.

Although this description contains many specifics, these should not be construed as limiting the scope of the invention but as merely providing illustrations of some of the presently preferred embodiments thereof, and of some of the various arrangements of doors and adjacent closure surfaces with which the invention may be used. The invention, as described herein, is susceptible to various modifications and adaptations, and the same are intended to be comprehended within the meaning and range of equivalents of the appended claims.

What is claimed is:

1. A portable privacy lock for use in securing a door that swings on hinges from an open position to a closed position in which the edge of the door opposite its hinged side is adjacent to a closure surface with a clearance gap therebetween, which lock comprises:

(a) a flexible webbing having a first end and a second end, which webbing is provided with a plurality of holes between said first and second ends;

(b) a first securing plate that is attached to the first end of the webbing;

(c) a second securing plate that is attached to the webbing at an intermediate position between the first and second ends thereof, said second plate being provided with a hole that is aligned with one of the holes in the webbing;

(d) a latch that is adapted to receive a drawstring and to releasably engage it from motion with respect thereto;

(e) a drawstring, one end of which is attached to the first plate or to the first end of the webbing, said drawstring being threaded through the holes in the webbing and the second plate to engagement with the latch;

whereby the first plate may be inserted through the clearance gap between the door and its adjacent closure surface and the latch disengaged from the drawstring so that said drawstring may be pulled to fold the webbing so that the second plate is moved into position across the clearance gap and on the opposite side thereof from the first plate so as to secure the door from motion with respect to the adjacent closure surface, whereupon the latch may be engaged to hold the drawstring so as to maintain the plates in position with respect to each other.

2. The lock of claim 1, wherein the first securing plate is attached along a portion of its length near its center to the webbing.

3. The lock of claim 1, wherein one end of the drawstring is attached to the first securing plate adjacent to its point of attachment to the webbing.

4. The lock of claim 1, wherein one end of the drawstring is attached to the first end of the webbing adjacent to its point of attachment to the first securing plate.

5. The lock of claim 1, wherein the second securing plate is attached substantially along its entire length to the webbing.

6. The lock of claim 1, wherein the first and second securing plates are adhesively attached to the webbing.

7. The lock of claim 1, wherein the first securing plate has a non-skid surface on the side thereof to which the webbing is attached.

8. The lock of claim 1, wherein the second securing plate has a non-skid surface on the side opposite that which is attached to the webbing.

9. The lock of claim 1, wherein the latch is adapted to releasably engage the drawstring from motion with respect thereto by frictional engagement.

10. The lock of claim 1, wherein the latch is attached to the webbing at or near the second end thereof.

11. The lock of claim 10, wherein the webbing is provided with three holes for passage of the drawstring therethrough, comprising a first hole near the point of attachment of the first securing plate to the webbing, a second hole in alignment with the hole in the second securing plate and a third hole near the point of attachment of the latch to the webbing.

12. The lock of claim 1, wherein the drawstring has a first end and a second end, and the first end of the drawstring is attached to the first securing plate adjacent to its point of attachment to the webbing, and a pouch that is adapted to contain the lock is attached to the second end of the drawstring.

13. A portable privacy lock for use in securing a door that swings on hinges from an open position to a closed position in which the edge of the door opposite its hinged side is adjacent to a closure surface with a clearance gap therebetween, which lock comprises:

(a) a flexible webbing having a first end and a second end, which webbing is provided with at least three holes between said first and second ends;

(b) a first securing plate that is attached along a portion of its length to the first end of the webbing;

(c) a second securing plate that is attached substantially along its entire length to the webbing at an intermediate position between the first and second ends thereof, said second plate being provided with a hole that is aligned with one of the holes in the webbing;

(d) a latch that is attached to the webbing near the second end thereof, said latch being adapted to receive a drawstring and to releasably engage it from motion with respect thereto;

(e) a drawstring, one end of which is attached to the first securing plate or to the first end of the webbing, said drawstring being threaded through:

(i) a first hole in the webbing near the point of attachment of the first securing plate to the webbing;

(ii) a second hole in the webbing that is in alignment with the hole in the second securing plate; and (iii) a third hole in the webbing near the point of attachment of the latch to the webbing;

to the latch for engagement therewith;

whereby the first plate may be inserted through the clearance gap between the door and its adjacent closure surface and the latch disengaged from the drawstring so that said drawstring may be pulled to fold the webbing so that the second plate is moved into position across the clearance gap and on the opposite side thereof from the first plate so as to secure the door from motion with respect to the adjacent closure surface, whereupon the latch may be engaged to hold the drawstring so as to maintain the plates in position with respect to each other.

14. The lock of claim 13, wherein one end of the drawstring is attached to the first end of the webbing by being sewn thereto.

15. The lock of claim 13, wherein the first end of the webbing is attached to the first securing plate near a central portion thereof.

16. The lock of claim 13, wherein the first and second securing plates are adhesively attached to the webbing.

17. The lock of claim 13, wherein the first securing plate has a non-skid surface on the side thereof to which the webbing is attached.

18. The lock of claim 13, wherein the second securing plate has a non-skid surface on the side opposite that which is attached to the webbing.

19. The lock of claim 13, wherein the latch is adapted to releasably engage the drawstring from motion with respect thereto by frictional engagement.

20. The lock of claim 13, wherein the drawstring has a first end and a second end, and the first end of the drawstring is attached to the first end of the webbing adjacent to its point of attachment to the first securing plate, and a pouch that is adapted to contain the lock is attached to the second end of the drawstring.

* * * * *